United States Patent [19]

Elsholz

[11] Patent Number: 4,644,644

[45] Date of Patent: Feb. 24, 1987

[54] SHEAR-TYPE NAIL CLIPPER

[76] Inventor: John F. Elsholz, 14721 Cottonwood Pl., Bothell, Wash. 98011

[21] Appl. No.: 808,177

[22] Filed: Dec. 12, 1985

[51] Int. Cl.[4] ..... A45D 29/00

[52] U.S. Cl. ..... 30/28; 30/134; 132/75.5

[58] Field of Search ..... 30/28, 29, 134; 132/75.5

[56] References Cited

U.S. PATENT DOCUMENTS 846,924 3/1907 Kampfe ..... 132/75.5

3,825,961 7/1974 Klein ..... 30/28

*Primary Examiner*—Douglas D. Watts

*Attorney, Agent, or Firm*—Christensen, O'Connor, Johnson & Kindness

[57] ABSTRACT

A shear-type nail clipper that includes a base arm (1), a twisted arm (13), a stud (15) and an actuating lever arm (17) is disclosed. The base and twisted arms are joined together at one end; and, concave blades (25, 37) are formed in the other ends of these arms. The cutting edge of the blades face one another and lie generally orthogonal to the longitudinal axes of the base and twisted arms. The twisted arm is twisted such that its blade (37) is transveresly inclined with respect to the blade formed in the base arm. As a result, the gap between the blades varies from one side to the other. Formed in the edges of the base and twisted arms adajcent the narrow gap side of the blades are aligned flcrum protrusions (27, 35). Formed in the edge of the base and twisted arms adjacent to the wide gap side of the blades are stud flanges (23, 34). The stud (15) is mounted in holes located in the stud flanges and extends beyond th outer surface of the twisted arm. The lever arm (17) is mounted on the outer extension of the stud (15). When the lever arm is suitably oriented and manually moved toward the twisted arm, the blade end of the twisted arm is rotated toward the base arm. The apex of rotation is the point where the fulcrum protrusions meet. The end result is a shear-type cutting action, rather than a chop-type cutting action.

14 Claims, 4 Drawing Figures

SHEAR-TYPE NAIL CLIPPER

TECHNICAL AREA

This invention is directed to clippers and, more particularly nail clippers.

BACKGROUND OF THE INVENTION

Contemporary nail clippers comprise a pair of elongate diverging blade arms joined together at one end. Concave blades are formed in the other ends of the blade arms. A lever arm is mounted on a post that passes through holes formed in the spaced apart ends of the arms. The holes lie along the longitudinal axes of the blade arms. Nail clipping action is produced by appropriately orienting the lever arm and, then, manually moving the lever arm toward the adjacent blade arm. The result of this action moves the blade arms together and creates a chop-type cutting action. More specifically, after a nail is placed between the blades, a force is applied to the lever arm causing the lever arm to move toward the adjacent blade arm. As the force applied to the lever arm increases the blade arms are drawn together. As a result, the gap between the blades is closed. As the gap closes, the blades first move to the point where they encounter the nail. At this point, blade movement temporarily halts due to the resistance to cutting produced by the nail. Thereafter, as greater force is applied to the lever arm, the blade arm adjacent the lever arm begins to bow. A point is finally reached where the inertial energy stored in the bowed blade arm is adequate to force the blades to chop through the nail. When the blades begin to penetrate the nail, they gain momentum. This momentum increases until the blades finally bite through the nail with an explosive force. Examples of chop-type nail clippers that function in the foregoing manner are described in U.S. Pat. Nos. 2,774,138; 3,042,047; 3,088,204; and 3,189,996.

The force produced when the blades finally penetrate through the nail creates the four major disadvantages of prior art nail clippers. First, when the blades bite together at a high force level a loud "snap" occurs. The snap is caused by high-energy vibration in the metal, with a subsequent vibration of the surrounding air molecules and, hence, acoustic propagations through the air. It has been found that the resulting high-pitched snap is offensive to many people. In fact, it is so offensive that many people refuse to use prior art nail clippers for this reason alone. Such individuals tend to use less effective, and more expensive, cutting devices, such as small scissors and files, to trim their nails. While, per se, the high-pitched snap is normally not objectionable to other people, even such people become annoyed by the snapping action when it occurs in certain environments, namely public places.

In addition to the undesirable high-pitched "snap", prior art nail clippers have the disadvantage of randomly projecting nail fragments in a wide variety of directions. More specifically, as noted above, prior art nail clipper blades finish a cut with an explosive force. The explosive force propels nail fragments through the air in random directions. This result is particularly undesirable to fastidious people concerned about cleanliness, as the nail debris is scattered in clothing, carpeting, and places other than a waste receptacle. This disadvantage renders conventional chop-type clippers both annoying and unsanitary. It is unsanitary because nail beds are excellent sites for bacterial proliferation.

Further, the high-energy impact of the blade edges against one another rapidly dulls the blades. As a result, greater and greater force on the lever arm is required to cut nails efficiently as prior art nail clippers become duller and duller with use. As they become duller, frequently, prior art chop-type nail clippers produce a cutting force that is inadequate to cut thick or calcified nails.

Another disadvantage of prior art chop-type nail clippers is their tendency to split or crack brittle and polished nails. This result also occurs because of the sudden, high-force cutting action produced by contemporary nail clippers.

As an alternative to chop-type nail clippers, U.S. Pat. No. 846,924 proposes a nail clipper having jaws that close in an overlap shear cut manner. The major disadvantage of this relatively ancient proposal is a complicated mechanism used to accomplish the desired type of cut.

Therefore, it is an object of this invention to provide a new and improved nail clipper.

It is a further object of this invention to provide an uncomplicated nail clipper that cuts nails quietly, i.e., without a high-pitched snap.

It is another object of this invention to provide an uncomplicated nail clipper that does not propel nail debris in random directions as nails are clipped.

It is yet another object of this invention to provide a nail clipper that does not produce a high explosive force that tends to rapidly dull the blades of the nail clippers.

It is yet another object of this invention to provide a new and improved nail clipper that is ideally suited for clipping brittle and polished nails with a minimal amount of splitting or cracking of the nail or the material with which the nail is coated.

SUMMARY OF THE INVENTION

In accordance with this invention a shear-type nail clipper is provided. The shear-type nail clipper includes a base arm, twisted arm, a stud and a lever arm. The base and twisted arms are joined together at one end, and diverge away from one another. Blades are formed in the other ends of the base and twisted arms. The cutting edges of the blades face one another; and, lie generally orthogonal to the longitudinal axes of the base and twisted arms. The blade end of the twisted arms is twisted such that its blade is transversly inclined with respect to the blade formed in the base arm. Thus, the gap between the blades varies from one side to the other. The stud is mounted in aligned holes in the base and twisted arms. The holes are adjacent to the wide gap side of the blades and the stud extends beyond the outer surface of the twisted arm. One end of the lever arm is attached to the outwardly extending portion of the stud. When the lever arm is suitably oriented and manually moved toward the twisted arm, the blade end of the twisted arm is moved toward the base arm. The movement is such that the narrow gap side of the blades first impinge on one another. Thereafter, shear-type action across the blades occurs as the wide gap side of the blades are moved into contact. Preferably the blades have a concave shape.

In accordance with further aspects of this invention, the base and twisted arms include fulcrum flanges located on the narrow gap side of the blades. When the arms are moved toward one another, the apex of the shear-type rotational action is the point where the flanges meet. Preferably, each fulcrum flange supports a fulcrum protrusion. The fulcrum protrusions are positioned so as to face one another and form the actual apex of the shear-type rotational action.

In accordance with still further aspects of this invention, stud flanges are located on the wide gap side of the blades, preferably in lateral alignment with the fulcrum flanges. The stud is mounted in aligned holes formed in the stud flanges. Further, the actuating end of the lever arm is enlarged to provide a widened lever pad that makes more comfortable and more efficient the manual application of force to the clipper.

As will be readily appreciated from the foregoing description, the nail clipper of the invention cuts with a shear-type action, as opposed to a chop-type action. As a result, no undesiragle high-pitched snap occurs when nails are clipped. Further, because of the shear-type action, nail debris is not randomly propelled from the clipper. Rather, the nail debris can be readily directed toward (i.e., dropped into) a suitable receptacle. Further, because high energy impact between the blades is avoided, the rate of blade dulling is reduced. In addition, because a shear-type, rather than a chop-type, cutting action is produced, brittle and polished nails can be readily cut by the invention without being split or cracked.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
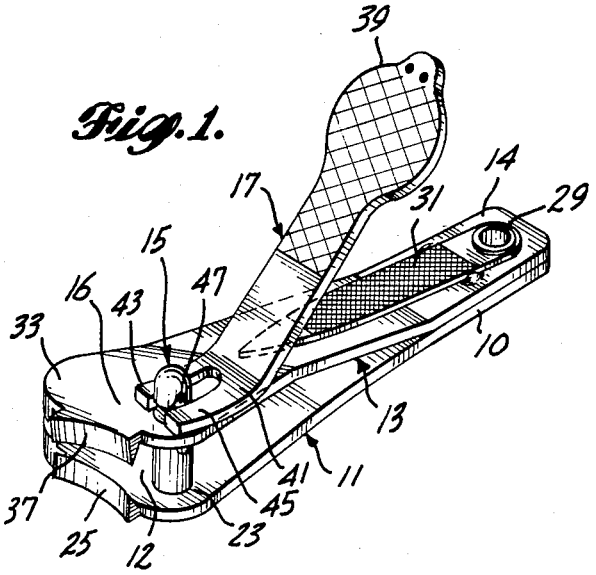
FIG. 1 is a perspective view of a shear-type nail clipper formed in accordance with the invention.

As illustrated in the FIGURES, a shear-type nail clipper formed in accordance with the invention comprises: a base arm 11; twisted arm 13; a stud 15; and a lever arm 17. Both the base arm 11 and the twisted arm 13 are elongate, of substantially the same length and formed of a suitable spring steel material. The base arm 11 is generally flat and includes a relatively narrow end 10 and an enlarged end 12. The narrow end 10 includes a hole; and, the enlarged end 12 includes a fulcrum flange 21 located on one edge and a stud flange 23 located on the other edge. The fulcrum flange 21 and the stud flange 23 are transversely aligned with one another. Located on the end of the base arm 11, between the fulcrum and stud flanges 21 and 23 is a concave blade 25. As with a conventional chop-type nail clipper, the concave blade 25 is chisel shaped and protrudes upwardly from the upper surface of the base arm 11. Further, a stud hole is located in the stud flange 23 of the base arm 11; and, a fulcrum protrusion 27 is formed atop the fulcrum flange 21, at the leading edge thereof adjacent the nearest end of the concave blade 25.

The twisted arm 13 also includes a narrow end 14 and an enlarged end 16. The narrow end 14 is generally flat and includes a hole. The holes in the narrow ends 10, 14 of the base and twisted arms 11, 13 are aligned with one another. A hollow rivet 29 is mounted in the holes in the narrow ends and joins the base and twisted arms together, such that the twisted arm overlies the base arm. The hollow rivet 29 also attaches a small file 31 to the nail clipper. As shown, the file may lie atop the twisted arm 13. Further, the hollow rivit 29 allows the nail clipper to be attached to a key chain or other suitable support device.

In the region where the twisted arm 13 is attached to the base arm 11, the twisted arm is flat, as noted above. The flat region of the twisted arm extends a predetermined distance, denoted A in FIG. 3, along the length of the base arm. At the end of distance A, at a point denoted X, the twisted arm is bent such that it diverges away from the base arm 11. The angle of divergence remains the same across the width of the base and twisted arms for a predetermined distance, denoted B in FIG. 3. At the end of distance B a twist starts to form in the twisted arm 13.

The twist begins along a line that extends from a point (denoted Y), located along one edge of the twisted arm 13, to a point (denoted Z) located along the other edge of the twisted arm. Point Y lies on the same side of the twisted arm 13 as a hereinafter described stud flange 34 formed in the twisted arm. Point Z lies on the same side of the twisted arm as a hereinafter described fulcrum flange 33 also formed in the twisted arm. Further, point Z lies downstream of point Y, i.e., point Z lies further away from the hollow rivit 29 than point Y. Thus, the twist start line, i.e., the line extending from point Y to point Z lies transverse to the longitudinal axis of the nail clipper.

The stud flange 34 formed in the twisted arm is aligned with the stud flange 23 formed in the base arm. Further, the twisted arm stud flange 34 includes a hole that is aligned with the hole in the base arm stud flange 23. The fulcrum flange 33 formed in the twisted arm 33 is algined with the fulcrum flange 21 formed in the base arm 11. Further, the twisted arm fulcrum flange 33 includes a fulcrum protrusion 35 formed in its lower surface that is aligned with the fulcrum protrusion 27 formed atop the base arm fulcrum flange 21.

As a result of the twist, the fulcrum flange side of the base and twisted arms are closer together than the stud flange side. The twist is such that the fulcrum protrusions 27 and 35 almost touch prior to the nail clipper of the invention being actuated in the manner hereinafter described to clip a nail. Located in the end of the twisted arm 13, between the stud flange and the fulcrum flange is a concave blade 37. The concave blade 37 formed in the twisted arm is chisel shaped and aligned with the concave blade 25 formed in the end of the base arm 11. Because of the twist in the twisted arm 13, the gap between the blades 25 and 37 linearly varies from a large value on the stud flange side of the twisted and base arms to a small value on the fulcrum flange side.

The stud 15 includes a collar 38 located at one end. The other end of the stud is hook shaped. The stud 15 is mounted in the holes formed in the stud flanges such that the collar 38 lies against the outer surface of the base arm 11 and the hook-shaped end extends beyond the outer surface of the twisted arm, when the lever arm 17 is attached to the stud 15 in the manner hereinafter described.

Figure 3:
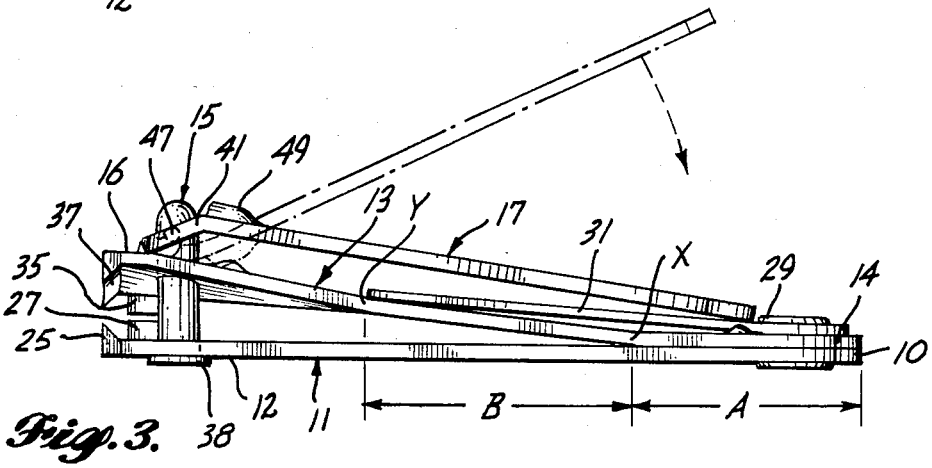
FIG. 3 is a longitudinal side view of the shear-type nail clipper illustrated in FIG. 1; and, FIG. 4 is a top plan view of the shear-type nail clipper illustrated in FIG. 1.

The lever arm 17 is generally flat and includes an enlarged end 39. The other end of the lever arm 17 is J-shaped. The J-shaped end defines a flange 41 that both curves outwardly, when projected into the plane defined by the main portion of the lever arm (FIG. 4), and at the same time angles outwardly from the plane defined by the main portion of the lever arm (FIGS. 1 and 3). Formed in the flange 41 is a yoke that includes a pair of outwardly projecting arms 43 and 45. Extending across the arms is a unitary bar 47. Located at the inner end of the yoke, on the outer side of the lever arm 17, is a protrusion 49. The enlarged end 39 forms a widened lever pad that makes the application of the manual cutting force more efficient and more comfortable.

Figure 2:
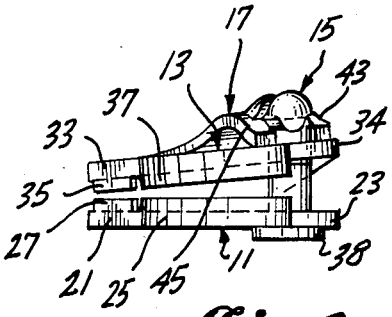
FIG. 2 is a blade-end view of the shear-type nail clipper illustrated in FIG. 1.
Figure 4:
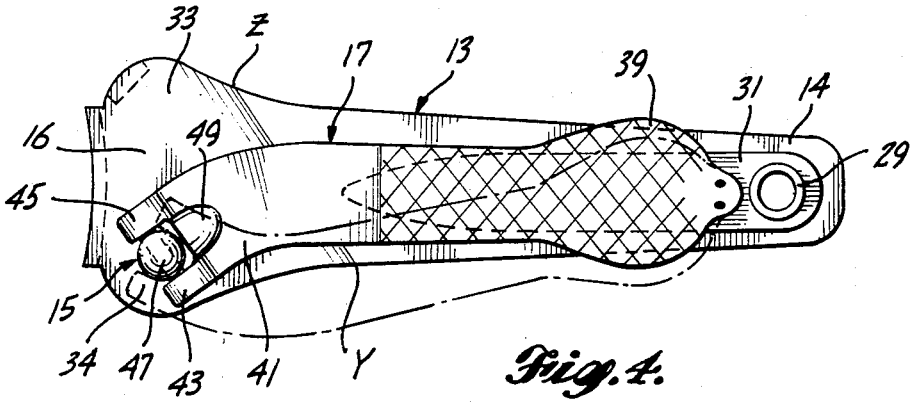

The shear-type nail clipper of the invention is assembled by mounting the stud in the holes in the stud flanges in the base and twisted arms 11, 13 such that the hook shaped end of the stud extends beyond the outer surface of the twisted arm 13. If necessary, this is accomplished by pressing the base and twisted arms together, against the spring force produced by the arms. Thereafter, the bar 47 of the lever arm 17 is inserted in the aperture formed in the hook shaped end of the stud 15. When appropriately assembled as illustrated in the drawings, the arms 43 and 45 of the lever arm lie on either side of the stud 15. Preferably, the lever arm 17 is positioned such that when it overlies and angles away from the upper surface of the twisted arm 13 (as shown in FIG. 1), the solid portion of the hook shaped end of the stud 15 faces the blades 35. When the lever arm is in this position it is ready to be moved toward the twisted arm 13 and create the hereinafter described nail cutting action. The lever arm is moved to a storage position by rotating the lever arm, and thus the stud 15, through a 180° to a position where the lever arm 17 generally overlies the blades, rather than the twisted arm 13. Thereafter, the lever arm 17 is rotated about the bar 47, toward the twisted arm, until it impinges on the file 31, as shown in FIGS. 2–4.

When the lever arm 17 is in the solid line position illustrated in FIG. 1 (also the dotted line position illustrated in FIG. 3), the nail clipper is ready to cut nails. A nail inserted between the concave blades 25, 37 is cut in a shear action when the lever arm 17 is moved toward the twisted arm 13. Shear cutting action occurs because the twisted part of the twisted arm 13 is rotated about a fulcrum point that occurs where the fulcrum protrusions 27 and 35 formed in the fulcrum flanges 21 and 33 meet. The resulting rotary movement cause a blade shear cut action. First the narrow gap side of the blades, i.e., the side of the blades toward the fulcrum flanges impinge on one another. Continued movement of the lever arm 17 toward the twisted arm 13 causes a shear action to occur between the blades. Shear action ends when the wide gap side of the blades meet one another.

As will be readily appreciated from the foregoing description, the invention provides a shear-type nail clipper. Shear cutting action is accomplished with the minimal number of components used to form prior art chop-type nail clippers. Thus, the invention is uncomplicated. Yet, the disadvantages of prior art chop-type nail clippers are avoided. That is, no sharp snap noise occurs with the present invention. Further, nails are cut in a manner such that they are not propelled in different directions from the nail clipper. Rather, they are cut in a manner that allows them to be readily dropped into a suitable receptiale. Further, because the cutting action is a shear-type action, rather than a chop-type action, the cutting blades remain sharp for a significantly longer period of time. Finally, the invention is ideally suited for use with brittle and polished nails because a shear-type cutting action cuts nails with little or no splitting or cracking.

While a preferred embodiment invention has been illustrated and described, it will be appreciated that various changes can be made therein without departing from the spirit and scope of the invention. For example, the blades may be straight, rather than concave. Or, the fulcrum may be formed in another manner. Further, the stud may be located nearer to, or at, the centerline of the base and twisted arms, even though the location of the stud in stud flanges as illustrated and described is preferred because lower cutting force is required. Still further, in some embodiments of the invention, the fulcrum flanges and fulcrum protrusions may be deleted and the narrow side of the blades allowed to function as the fulcrum point. Also, the base arm may have a bend similar to the bend in the twisted arm, i.e., the base arm may also be twisted. Consequently, the invention can be practiced otherwise than as specifically described herein.

The embodiments of the invention in which an exclusive property or privilege is claimed are defined as follows:

1. A shear-type nail clipper comprising:

a base arm having an attachment end and a blade end, said base arm including a transverse blade formed in said blade end and a hole located near said blade end;

a twisted arm having an attachment end, a blade end and a twist located between said attachment end and said blade end, said twisted arm including a transverse blade formed in said blade end and a hole located near said blade end;

attachment means for attaching said attachment ends of said base arm and said twisted arm together such that said transverse blades formed in said blade ends of said base arm and said twisted arm are aligned with one another, said twist in said twisted arm causing said blade formed in said blade end of said twisted arm to be canted with respect to said blade formed in said blade end of said base arm;

said base arm and said twisted arm each including a stud flange located along the edges of said base arm and said twisted arm adjacent to the wide side of said canted blades, said holes located near the blade ends of said base arm and said twisted arm being formed in said stud flanges;

a stud mounted in said holes located near the blade ends of said base arm and said twisted arm; and, a lever arm having a bend formed in one end, said bend end of said lever arm attached to said stud in a manner such that said lever arm can be positioned so as to overlie and diverge from said twisted arm and such that movement of said lever arm toward said twisted arm when said twisted arm is positioned so as to overlie and diverge away from said lever arm causes said blade formed in said blade end of said twisted arm to move toward said blade formed in said blade end of said base arm such that a shear cutting action occurs as said blades meet.

2. A shear-type nail clipper as claimed in claim 1, wherein said transverse blades formed in said blade end of said base arm and said twisted arm are concave.

3. A shear-type nail clipper as claimed in claim 1 wherein said base arm and said twisted arm include aligned fulcrum flanges formed in their edges adjacent the narrow side of said canted blades.

4. A shear-type nail clipper as claimed in claim 3 including a fulcrum protrusion located on each of said fulcrum flanges on the surface thereof facing one another.

5. A shear-type nail clipper as claimed in claim 4 wherein said fulcrum protrusions are located near the leading edges of said fulcrum flanges immediately adjacent the narrow side of said canted blades.

6. A shear-type nail clipper is claimed in claim 5, wherein said transverse blades formed in said blade end of said base arm and said twisted arm are concave.

7. A shear-type nail clipper as claimed in claim 5, wherein said transverse blades formed in said blade end of said base arm and said twisted arm are concave.

8. A shear-type nail clipper as claimed in claim 5 wherein said twist in said twisted arm commences along a line extending transversely across said twisted arm, said transverse line being located near said attachment end of said base and twisted arms on the side of said twisted arm in which said stud flange is formed and further away from said attachment end of said twisted arm on the side of said twisted arm in which said fulcrum flange is formed.

9. A shear-type nail clipper as claimed in claim 8, wherein said transverse blades formed in said blade end of said base arm and said twisted arm are concave.

10. A shear-type nail clipper as claimed in claim 3, wherein said transverse blades formed in said blade end of said base arm and said twisted arm are concave.

11. A shear-type nail clipper as claimed in claim 3 wherein said twist in said twisted arm commences along a line extending transversely across said twisted arm, said transverse line being located near said attachment end of said base and twisted arms on the side of said twisted arm in which said stud flange is formed and further away from said attachment end of said twisted arm on the side of said twisted arm in which said fulcrum flange is formed.

12. A shear-type nail clipper as claimed in claim 11, wherein said transverse blades formed in said blade end of said base arm and said twisted arm are concave.

13. A shear-type nail clipper as claimed in claim 1 wherein said twist in said twisted arm commences along a line extending transversely across said twisted arm.

14. A shear-type nail clipper as claimed in claim 13, wherein said transverse blades formed in said blade end of said base arm and said twisted arm are concave.

* * * * *